United States Patent [19]

Solomon

[11] Patent Number: 4,714,165

[45] Date of Patent: Dec. 22, 1987

[54] STORAGE RACK

[76] Inventor: Jack Solomon, 169 Lindell Blvd., Long Beach, N.Y. 11561

[21] Appl. No.: 756,016

[22] Filed: Jul. 17, 1985 (Under 37 CFR 1.47)

[51] Int. Cl.[4] ..... B42F 17/12

[52] U.S. Cl. ..... 211/11; 211/40; 211/50; 211/184

[58] Field of Search ..... 211/184, 42, 40, 59.4, 211/11, 41, 50, 187

[56] References Cited

U.S. PATENT DOCUMENTS

| | | | |
|---|---|---|---|
| 135,894 | 2/1873 | Dearing | 211/59.4 |
| 542,912 | 7/1895 | Wood | 211/41 |
| 578,755 | 3/1897 | Linn | 211/42 |
| 640,315 | 1/1900 | Parmalee | 211/42 |
| 1,712,342 | 5/1929 | Fitzgerald | 211/41 |
| 2,222,974 | 11/1940 | Bow | 211/184 |
| 2,522,483 | 9/1950 | Plack | 211/11 |
| 2,889,055 | 6/1959 | Weller et al. | 211/184 |
| 3,107,012 | 10/1963 | Rothenborg | 211/11 |
| 3,271,626 | 9/1966 | Howilka | 211/41 |
| 3,408,128 | 10/1968 | Kump | 211/184 |
| 3,501,019 | 3/1970 | Armstrong et al. | 211/184 |
| 3,733,523 | 5/1973 | Reynolds et al. | 211/41 |
| 3,759,395 | 9/1973 | Juhlin | 211/11 |
| 3,872,802 | 3/1975 | Scheerhorn et al. | 211/184 |
| 4,511,194 | 4/1985 | Park et al. | 211/40 |
| 4,533,977 | 8/1985 | Koppensteiner et al. | 211/41 |

FOREIGN PATENT DOCUMENTS

| | | | |
|---|---|---|---|
| 1237830 | 6/1960 | France | 211/184 |
| 480505 | 2/1938 | United Kingdom | 211/184 |
| 520000 | 4/1940 | United Kingdom | 211/41 |

*Primary Examiner*—William F. Pate, III
*Assistant Examiner*—Michael Safavi
*Attorney, Agent, or Firm*—Darby & Darby

[57] ABSTRACT

This invention relates to an esthetically pleasing, practical and functional storage rack particularly suited for storage of soft cover items. In its preferred embodiment, the storage rack comprises top, bottom and side panels that include tracks positioned so that dividers are detachably engaged in said tracks. Apertures are located in the panels to increase the visability of the items contained within the rack, and ridges are positioned adjacent the apertures to support the items and give strength to the housing.

10 Claims, 6 Drawing Figures

STORAGE RACK

BACKGROUND OF THE INVENTION

This invention relates to storage racks and more particularly, to esthetically pleasing and well constructed storage racks used to retain or store items, particularly softcover items such as telephone books, workbooks, magazines, training manuals, loose papers, etc., in a neat and organized manner.

Today, the average person accumulates an inordinate amount of paper. Magazines, for example, are delivered to libraries, homes and offices monthly, weekly and even daily. While some magazines can be quickly read and discarded, a number of magazines are often kept for future reference. Although many publications are stored on microfiche and by other modern means, the average person may not have such conveniences available and/or may prefer to keep the paper copies. Also, on items such as telephone books, microfiche and other types of storage are impractical for the average person.

Furthermore, today's average person demands a storage product that is well constructed and that can withstand ordinary wear and tear. Since storage racks are not necessarily "stored away", there is a great need for a storage rack that is well designed, attractive, modern—a storage rack which fits well and coordinates with today's interiors. The ideal product is preferably relatively inexpensive, in addition to being practical and functional.

Conventional storage products do not fully meet these needs. Some storage products, for example, allow a person to neatly store and arrange items, but the storage device itself is not esthetically pleasing and, hence, cannot be displayed. Other storage products, in attempting to hold items in a neat and organized fashion, totally cover the items so that a person cannot see the item that is stored within the product. Still others fail to provide the support needed to protect soft covered books and magazines. These defects in prior products result in much inconvenience and, in fact, may defeat the purpose of storage when the stored objects are not readily accessible or are not sufficiently protected.

SUMMARY OF THE INVENTION

An object of the present invention is to remedy the problems outlined above. In particular, an object of the invention is to provide a storage rack that is well constructed, esthetically pleasing, and practically suited for the average consumer.

The foregoing and other objects are attained in accordance with the invention by providing a storage rack comprising a housing formed with front and back panels having a plurality of apertures, a bottom panel and partial top panel containing a plurality of parallel tracks, and a right panel containing a plurality of parallel tracks. The tracks along the top, bottom and right panels are identically positioned to create pairs of tracks that accommodate one or more removable dividers positioned within the corresponding track pairs. The removable divider may or may not be used by the particular user, depending on the size of items he intends to store.

The divider may be positioned along any of the tracks in the bottom and top panel by sliding the divider along the tracks. A latching means located at the bottom rear of the divider cooperates with the housing to hold the divider securely in place in the housing. This latching means is effective in that it prevents the divider from sliding out of the housing or from sliding out from a particular track, regardless of the set of tracks it is used in. The divider, front and back panels are essentially similarly shaped in the preferred embodiment, although they need not be.

In the preferred embodiment, the divider has a plurality of parallel raised ridges on both sides, which ridges give the divider strength and permit it to hold even relatively heavy, soft-covered items in an upright position. The front and back panels also have a plurality of parallel raised ridges; however, in the preferred embodiment, the ridges are found only on the sides of the panels which face the interior portion of the rack. Since the ridges are not found on the external portions of the housing, there are no projections on the exterior sides of the racks. Thus, the racks can be neatly arranged side by side in a manner that conserves space and the sides can be decorated in a manner that might not be possible if the ridges were carried to the exterior sides. The raised ridges not only give added strength to the unit, they also help to contain the items housed in the rack so that loose edges do not protrude through the apertures found throughout the front, back and divider panels. This represents a compromise between the need to see the items contained in the storage rack and to contain the items neatly within the storage rack.

BRIEF DESCRIPTION OF THE DRAWINGS

A better understanding of the invention may be gained from a consideration of the following detailed description of a preferred embodiment thereof, in conjunction with the appended figures of the drawing, wherein.

DESCRIPTION OF THE PREFERRED EMBODIMENTS

Figure 1:
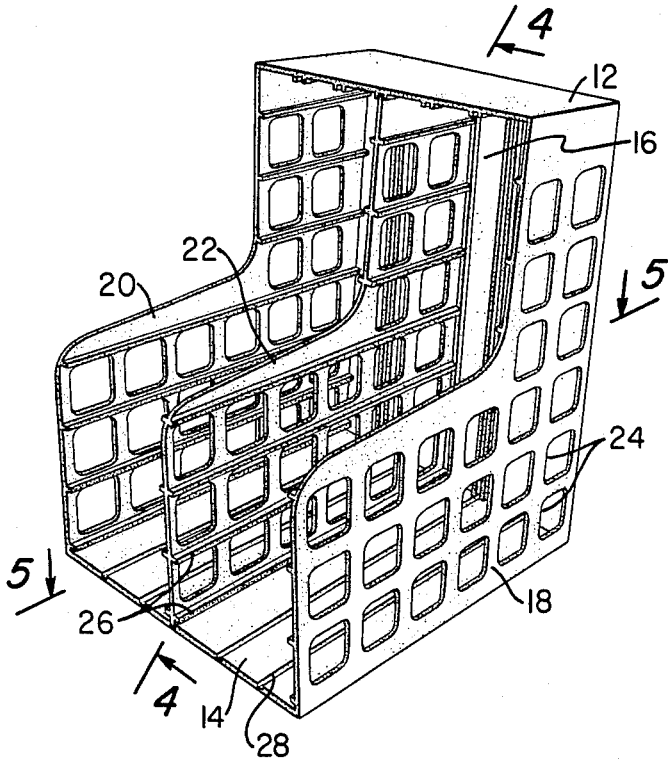
FIG. 1 is a perspective view of a preferred embodiment of a storage rack constructed in accordance with the invention.
Figure 2:
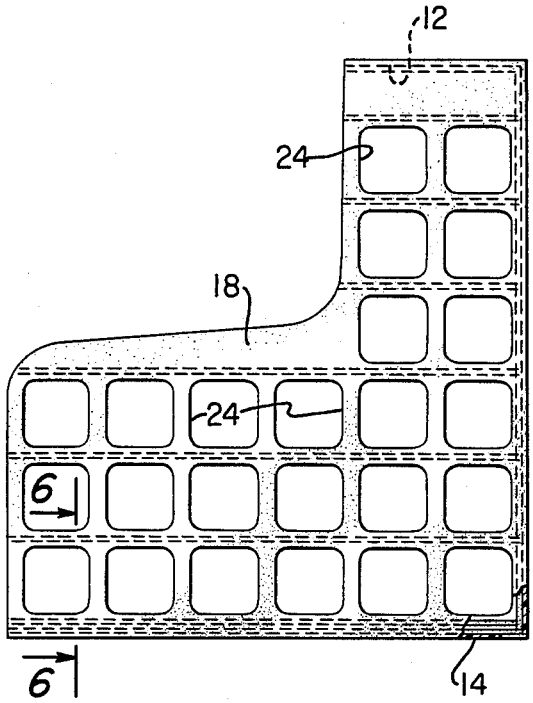
FIG. 2 is a front view of the rack of FIG. 1.

FIG. 1 shows a storage rack 10 constructed in accordance with the invention. It comprises a front panel 18 (shown also in FIG. 2) which contains a plurality of apertures 24. Each aperture is identical in size and shape, and they are arranged in parallel rows and columns to achieve an orderly effect. The front panel also contains ridges 30 which are arranged horizontally on the side facing the interior of the storage rack. These ridges are spaced in between the rows of apertures and run thoughout the length of the front panel. The back panel 20 is identical in overall shape to the front panel except that its ridges 34 are on the opposite side so as to project toward the interior of the rack. Both these panels 20,22 have a cutout area extending from the top panel 12 to the open side of the rack below the level of the top so that the rack has a generally reversed L-shaped appearance. This allows soft-backed books and papers to be grasped easily from the side while still providing ample support.

The bottom and partial top panels (14 & 12 respectively) contain five pairs of similarly spaced tracks 27,28. Also, right side panel 16 has vertical tracks 29. The tracks 27,28 and 29 are spaced so that they meet each other where the bottom panel meets the right side panel and where the right side panel meets the partial top panel. That is, the bottom panel tracks 28 meet the right side panel tracks 29 at the bottom right-hand side of the storage rack. The right side panel tracks 29 meet the partial top panel tracks 27 at the top right hand side of the storage rack.

The front, back, right side, bottom and partial top panels are permanently secured to each other and together make up the housing. The bottom panel, right side panel and partial top panel may be of a one piece wrap around construction which may be formed by molding or extruding a heavy duty, durable plastic material. The front and back may be similarly made and attached to the other parts in any suitable manner.

Figure 3:
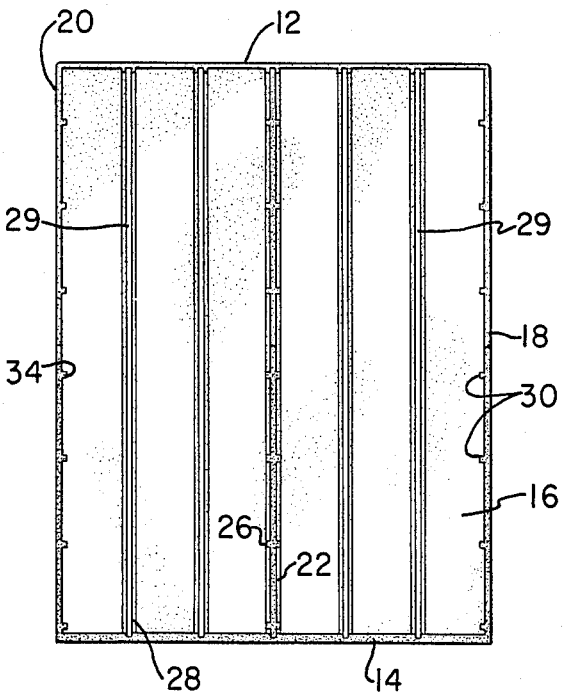
FIG. 3 is a left side view of the rack of FIG. 1 with a divider in the middle track.

One or more dividers, exemplified by divider 22, may be used in conjunction with the housing. The divider has apertures in parallel rows and columns that correspond to those in the front and back panels. The divider also contains ridges 26 on both sides of the divider that run horizontally between the horizontal rows of apertures. The ridges run on both sides of the divider as shown in FIG. 3. FIG. 3 also clearly shows the ridges 30 of the front panel and ridges 34 of the back panel. The ridges act to strengthen the panels and dividers, and to deflect the edges of papers slid into the housing away from the apertures. In a preferred embodiment, the ridges taper at ends 27 and act to guide papers and other items which are slid into the rack. In addition the tracks 29 of the right side panel are clearly shown in FIG. 3.

Figure 4:
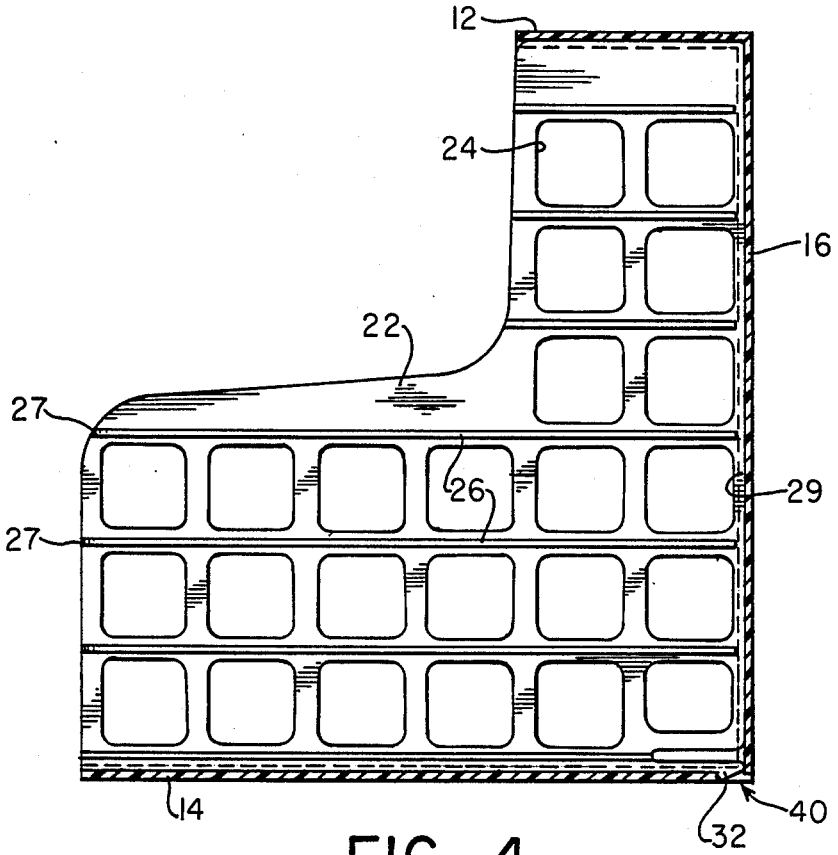
FIG. 4 is a sectional view taken along the line 4—4 of FIG. 1 and looking in the direction of the arrows.

FIG. 4 shows a cross section of the housing with a divider in place in the housing. The bottom right hand side of the divider has a latching means 32 which secures the divider in place in the housing. This latching means is a projecting hook which is preferably made in one piece with the divider.

The divider is inserted by initially sliding it along any one of the several bottom panel tracks. When the top of the divider contacts the track in the partial top panel which corresponds to the track of the bottom panel in which it is sliding, continued motion of the divider causes the latching means to bend upwardly, which is permitted by the resilience of the plastic material from which it is made. Once the divider is fully inserted, the latching means snaps down into an opening 40 which extends along the back of the bottom panel, thereby securing it in place. Also the right hand side of the divider meets the track 29 on the right side panel.

Figure 5:
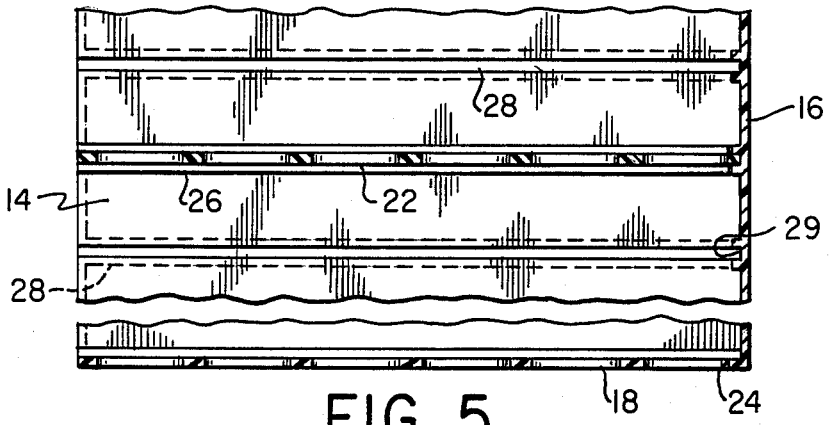
FIG. 5 is a portion of a sectional view taken along the line 5—5 of FIG. 1 and looking in the direction of the arrows.

FIG. 5 represents a cross sectional view from the top of the housing when a least one divider 22 is in place. In FIG. 5, there is a clear top view of the tracks 28 of bottom panel 14. There is also a cross-sectional view of the tracks 29 on the right side panel 16 and a cross sectional view of the front panel 18 showing apertures 24.

Figure 6:
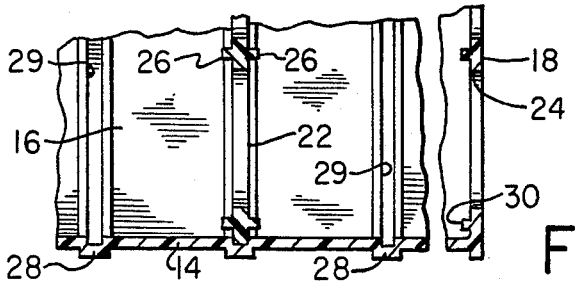
FIG. 6 is a portion of an enlarged sectional view taken along the line 6—6 of FIG. 2 and looking in the direction of the arrows.

FIG. 6 is a portion of a left-side cross-sectional view of the storage rack with a divider in place. In FIG. 6 there is shown the bottom panel 14 in which the tracks 28 are formed. Additionally, FIG. 6 shows the divider 22 in place as well as the ridges 26 on the divider. Similarly, front panel 18 with its ridges 30 is illustrated.

The laching means on the divider in cooperation with the tracks detachably secures the divider into place so that the divider serves to separate the items placed in the storage rack. The divider can be removed merely by applying sufficient pulling force on it to cause the latching hook to bend upward so as to clear slot 40. If necessary the latching means can be pushed up from the bottom to free the divider for removal.

A preferred embodiment of the storage rack also comprises a partial top panel as has been indicated throughout because such a partial panel provides support for the housing, but allows an item which is placed in the storage rack to be taken out most conveniently, i.e., the item can be pulled out and then lifted up. However, as can readily be appreciated, the top panel need not be partial.

Also, in the preferred embodiment, the rack is made of a durable and hard plastic.

Many modifications of the preferred embodiment of the invention disclosed herein will readily occur to those skilled in the art upon consideration of this disclosure. For example, the apertures may be deleted entirely or they may take a different shape, e.g., triangles instead of squares. These examples are only illustrative and by no means indicate the only modifications or the nature or degree of modifications. Accordingly, the invention is to be construed as including all embodiments thereof which fall within the scope of the appended claims.

What is claimed is:

1. A storage rack comprising:

housing means formed with front, back and bottom panels, a partial top panel, and one side panel so that the housing is open on one side;

said partial top, bottom and side panels containing a plurality of correspondingly arranged tracks so that the tracks of the partial top and bottom panels meet the tracks of the side panel; and at least one divider which is detachably engaged in and slideable along said tracks into and out of the open side of said housing, said divider including latching means for releasably locking said divider in said housing, said latching means including a part adapted to (i) resiliently project into a recess in said housing so as to detachably secure said divider when said divider is in position fully within said housing and (ii) withdraw from the recess so as to allow said divider to slide along said tracks, without tilting out of engagement with the tracks, when manual force is applied on the divider in the direction of the open side.

2. A storage rack according to claim 1 wherein the front panels and back panels have a cutout extending from the top panel to the open side of the housing below the top panel, the cutout being adapted to permit increased access to items within the housing.

3. A storage rack according to claim 1 wherein said front and back panels define a plurality of horizontally arranged rows of apertures to permit viewing of any contents placed within the storage rack.

4. A storage rack according to claim 3 wherein said front and back panels include horizontal rows of ridges in between said rows of apertures, said ridges being on at least the side of said panels facing the interior of said housing and being adapted to strengthen the panel.

5. A storage rack according to claim 1 wherein said divider defines a plurality of horizontally-arranged rows of apertures adapted to permit viewing of any contents placed within the storage rack.

6. A storage rack according to claim 5 wherein said divider includes horizontal rows of ridges in between said rows of apertures, said ridges being on at least one side of said divider and being adapted to strengthen the divider.

7. A storage rack according to claim 5 further including ridges on the front and back panels and on the said ridges having a taper toward the open side of the housing, the taper being designed to guide items slid into the housing; and wherein the ridges are adapted to deflect the edges of items slid into the housing away from the apertures.

8. A storage rack according to claim 7 wherein said rack is made of durable and hard plastics material.

9. A storage rack according the claim 1 wherein the latching means is one piece with said divider.

10. A storage rack according to claim 9 wherein the latching means and said divider are made of molded plastics material.

* * * * *